US011679601B2

(12) United States Patent
Swartz et al.

(10) Patent No.: US 11,679,601 B2
(45) Date of Patent: Jun. 20, 2023

(54) HOLDOWN PROCESS AND SYSTEM FOR PLATEN

(71) Applicant: Impossible Objects, Inc., Northbrook, IL (US)

(72) Inventors: Robert Swartz, Highland Park, IL (US); Eugene Gore, Des Plaines, IL (US); Drew Marschner, Chicago, IL (US)

(73) Assignee: Impossible Objects, Inc., Northbrook, IL (US)

( * ) Notice: Subject to any disclaimer, the term of this patent is extended or adjusted under 35 U.S.C. 154(b) by 312 days.

(21) Appl. No.: 16/876,035

(22) Filed: May 16, 2020

(65) Prior Publication Data

US 2020/0384783 A1 Dec. 10, 2020

Related U.S. Application Data

(60) Provisional application No. 62/849,021, filed on May 16, 2019.

(51) Int. Cl.
*B41J 11/06* (2006.01)
*B25B 5/04* (2006.01)

(52) U.S. Cl.
CPC ..... *B41J 11/06* (2013.01); *B25B 5/04* (2013.01)

(58) Field of Classification Search
CPC ..... B25B 5/04; B25B 5/006; B25B 5/003; B25B 5/14; B25B 5/145; B25B 5/00–166; B25B 1/00–2494
See application file for complete search history.

(56) References Cited

U.S. PATENT DOCUMENTS 4,620,695 A * 11/1986 Vanistendael ..... B25B 5/16 269/24
4,998,712 A * 3/1991 Park ..... H05K 13/0069 269/25
5,275,391 A * 1/1994 Lynn ..... B25B 5/006 269/238
5,312,154 A * 5/1994 Woodall ..... B25B 5/106 269/93
5,816,568 A * 10/1998 Fox ..... B25B 11/00 269/246
6,908,077 B2 * 6/2005 Sawdon ..... B25B 5/16 269/32

(Continued)

*Primary Examiner* — Lee D Wilson
*Assistant Examiner* — Robert F Neibaur
(74) *Attorney, Agent, or Firm* — Dunlap Bennett & Ludwig, PLLC

(57) ABSTRACT

A method/system of mechanical holdowns allows a substrate sheet in a CBAM (composite-based additive manufacturing technology) process to lie flat during printing. The invention includes a process of mechanically clamping sheets to be printed by a print head to a flat platen using a set of barrel cam driven clamping fingers. The finger supports are attached to the platen and the fingers can be raised and lowered with respect to the platen. Each finger can rotate while swinging downward toward a sheet at the edge of the platen. To clamp the sheet, the fingers are rotated to the perpendicular position and swung lower down to pinch the sheet to the platen. The process can include additional steps that release some, but not all, of the fingers to allow the sheet to relax before re-clamping them.

3 Claims, 4 Drawing Sheets

(56) References Cited

U.S. PATENT DOCUMENTS

| | | | | |
|---|---|---|---|---|
| 8,061,700 | B2 * | 11/2011 | Zhang | B25B 5/06 269/97 |
| 8,979,086 | B2 * | 3/2015 | Phillips | B25B 5/068 269/134 |
| 9,393,770 | B2 | 7/2016 | Swartz | |
| 9,776,376 | B2 | 10/2017 | Swartz | |
| 9,827,754 | B2 | 11/2017 | Swartz | |
| 9,833,949 | B2 | 12/2017 | Swartz | |
| 10,046,552 | B2 | 8/2018 | Swartz | |
| 10,252,487 | B2 | 4/2019 | Swartz | |
| 10,350,877 | B2 | 7/2019 | Swartz | |
| 10,377,080 | B2 | 8/2019 | Swartz | |
| 10,377,106 | B2 | 8/2019 | Swartz | |
| 10,384,437 | B2 | 8/2019 | Swartz | |
| 10,597,249 | B2 | 3/2020 | Swartz | |
| 10,682,741 | B2 * | 6/2020 | Boiteux | B25B 5/087 |
| 10,751,987 | B2 | 8/2020 | Swartz | |
| 10,934,120 | B2 | 3/2021 | Swartz | |
| 2009/0152784 | A1 * | 6/2009 | Yonezawa | B25B 5/062 269/27 |
| 2017/0151719 | A1 | 6/2017 | Swartz | |
| 2017/0291223 | A1 | 10/2017 | Swartz | |
| 2018/0072001 | A1 | 3/2018 | Swartz | |
| 2018/0264725 | A1 | 9/2018 | Swartz | |
| 2018/0264732 | A1 | 9/2018 | Swartz | |
| 2019/0084046 | A1 | 3/2019 | Swartz | |
| 2019/0202164 | A1 | 7/2019 | Swartz | |
| 2019/0366626 | A1 | 12/2019 | Swartz | |
| 2020/0223131 | A1 | 7/2020 | Swartz | |
| 2020/0384783 | A1 | 12/2020 | Swartz | |

* cited by examiner

"Clamped"Position

"Un Clamped" Position

HOLDOWN PROCESS AND SYSTEM FOR PLATEN

The following patents and applications are hereby incorporated by reference in their entireties: U.S. Pat. Nos. 9,776,376, 9,833,949, 10,046,552, 10,252,487, 10,377,080, 10,377,106, 10,384,437 and 10,597,249 and U.S. patent application Ser. Nos. 16/195,362, 16/544,906, 15/923,335, 15/922,158 and 16/711,313.

BACKGROUND

Field of the Invention

The present invention relates to an improvement in the platen in a 3D material printing machine and process, and more particularly to improved holdowns that hold a flat substrate sheet down during processing.

Description of the Problem Solved

In the assignee's prior applications and patents (as incorporated by reference above), mechanical and vacuum holdowns were used to hold the sheet in place while it was printed. Vacuum holdowns as described in the earlier disclosure require a vacuum which is expensive, produces significant noise, and uses substantial power. It would be advantageous to have a mechanical holdown that reduces the power consumption and the noise of the machine. In addition, the vacuum may sometimes cause a droplet at the inkjet head to mist, thus causing misprinting and reducing the printable area of the sheet. It would be advantageous to eliminate these problems.

SUMMARY OF THE INVENTION

The present invention is a new method and system of mechanical holdowns which allow a substrate sheet in a CBAM (composite-based additive manufacturing technology) process to lie flat during printing. The invention includes the process of mechanically clamping sheets to be printed by a print head to a flat platen using a set of barrel cam driven clamping fingers. The fingers are attached to the platen and can be raised and lowered with respect to the platen. In addition, while being raised or lowered, each finger can rotate at least ninety degrees to either face perpendicularly into the edge of the platen or to be parallel to the edge of the platen. To clamp the sheet, the fingers are rotated to the perpendicular position and lowered down to pinch the sheet to the platen. The process can include additional steps that release some, but not all, of the fingers to allow the sheet to relax before re-clamping them.

DESCRIPTION OF THE FIGURES

Attention is directed to the following figures that illustrate features of the present invention.

Figure 1A:
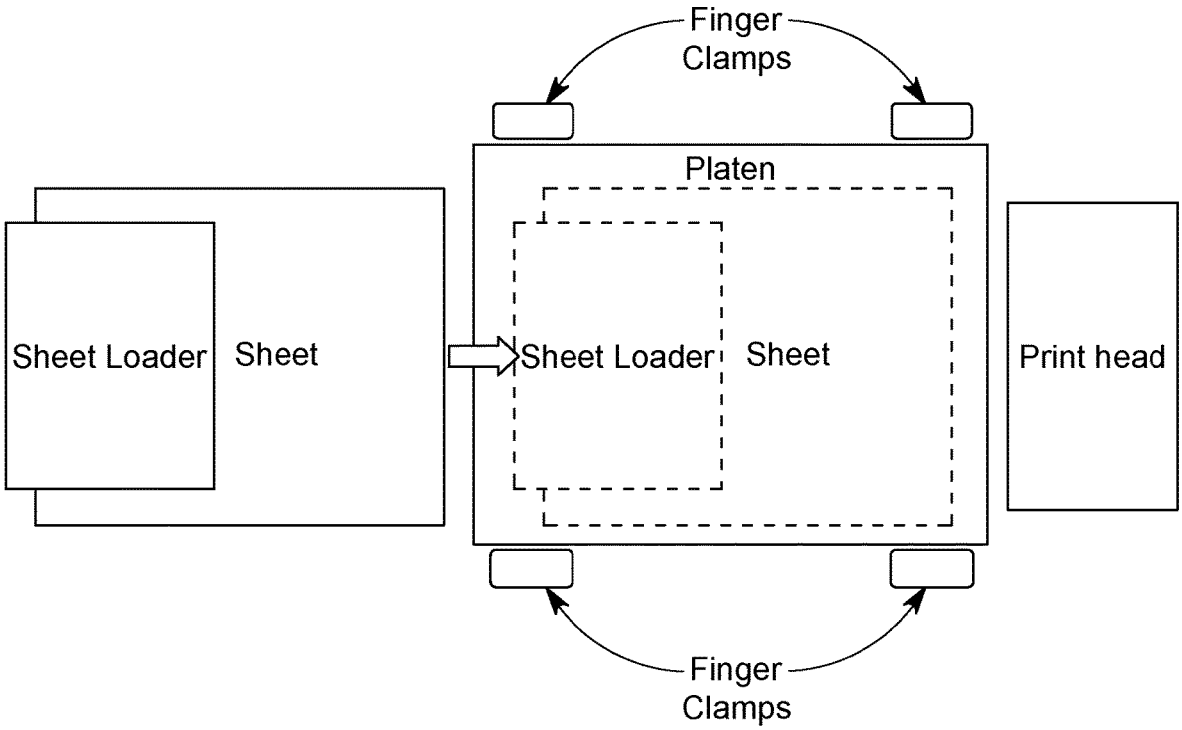
FIG. 1A shows a platen with four finger clamps. In a first step, all four clamps are in the unclamped configuration.

Several figures have been presented to aid in understanding the present invention. The scope of the present invention is not limited to what is shown in the figures.

DESCRIPTION OF THE PREFERRED EMBODIMENTS

The foregoing summary, as well as the following detailed description of the preferred embodiments of the invention, will be better understood when read in conjunction with the appended drawings. For the purpose of illustrating the invention, there are shown in the drawings embodiments that are presently preferred. It should be understood, however, that the invention is not limited to the precise arrangements and instrumentalities shown.

The invention includes the process of mechanically clamping sheets to be printed by a print head to a flat platen using a set of barrel cam driven clamping fingers. The fingers are attached to the platen and can be raised and lowered with respect to the platen. In addition during such raising or lowering, each finger can rotate at least ninety degrees to either face perpendicularly into the edge of the platen or to be parallel to the edge of the platen. To clamp the sheet, the fingers are rotated to the perpendicular position and lowered down to pinch the sheet to the platen. The process can include additional steps that release some, but not all, of the fingers to allow the sheet to relax.

Process Description

Figure 1B:
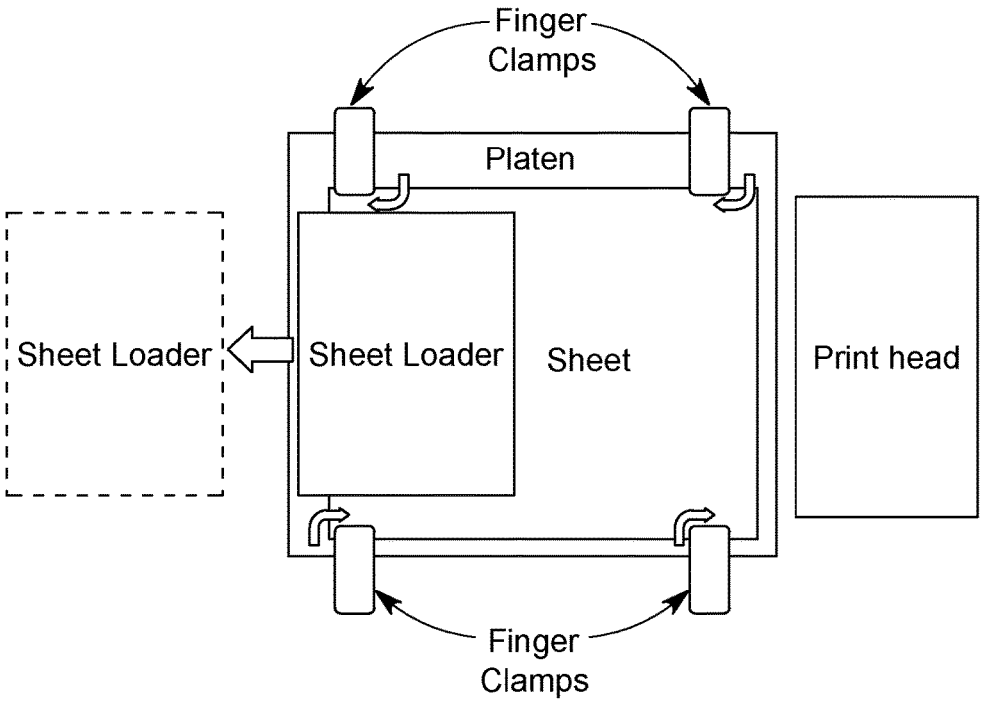
FIG. 1B shows a second step with the substrate sheet loaded and the clamps rotated and driven downward to the clamped configuration.
Figure 2A:
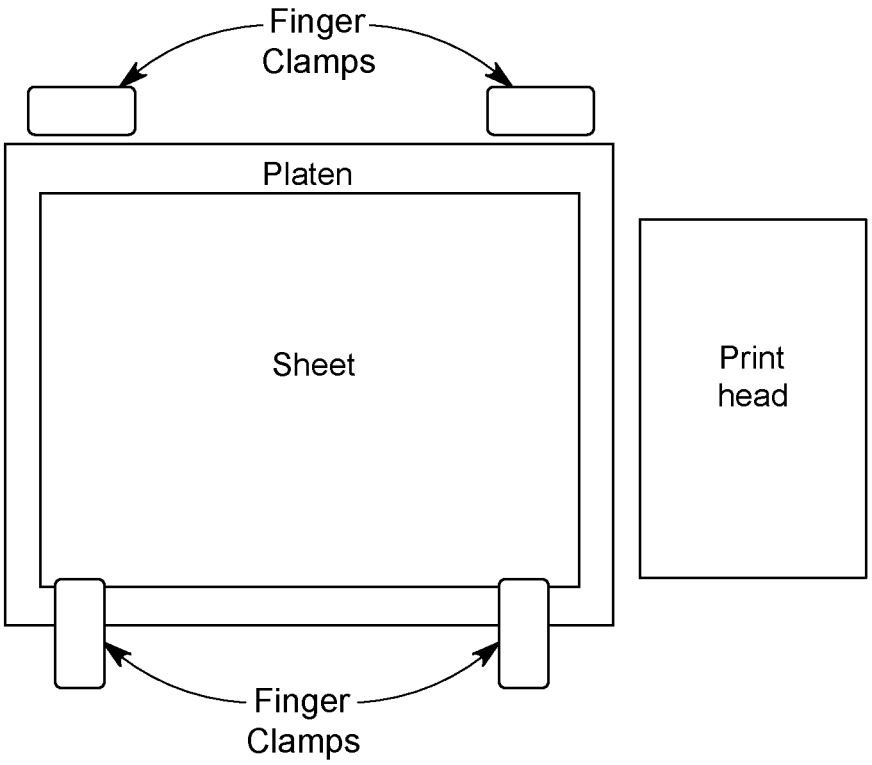
FIG. 2A shows a next step with two of the clamps in the unclamped configuration and two clamps in the clamped configuration.
Figure 2B:
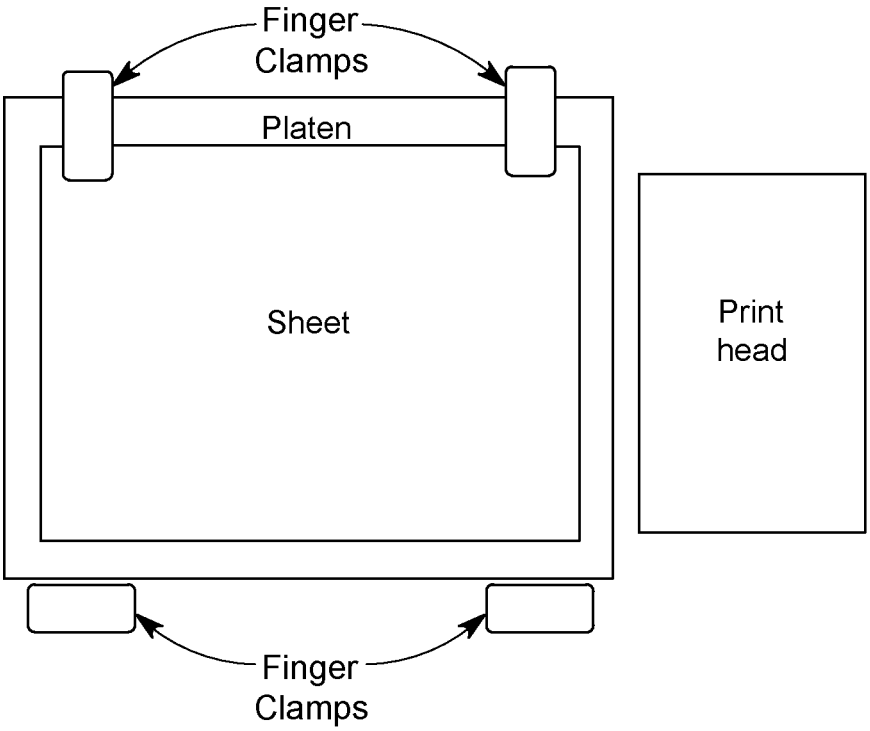
FIG. 2B shows a possible next step with the opposite two clamps relaxed in the unclamped configuration.
Figure 3:
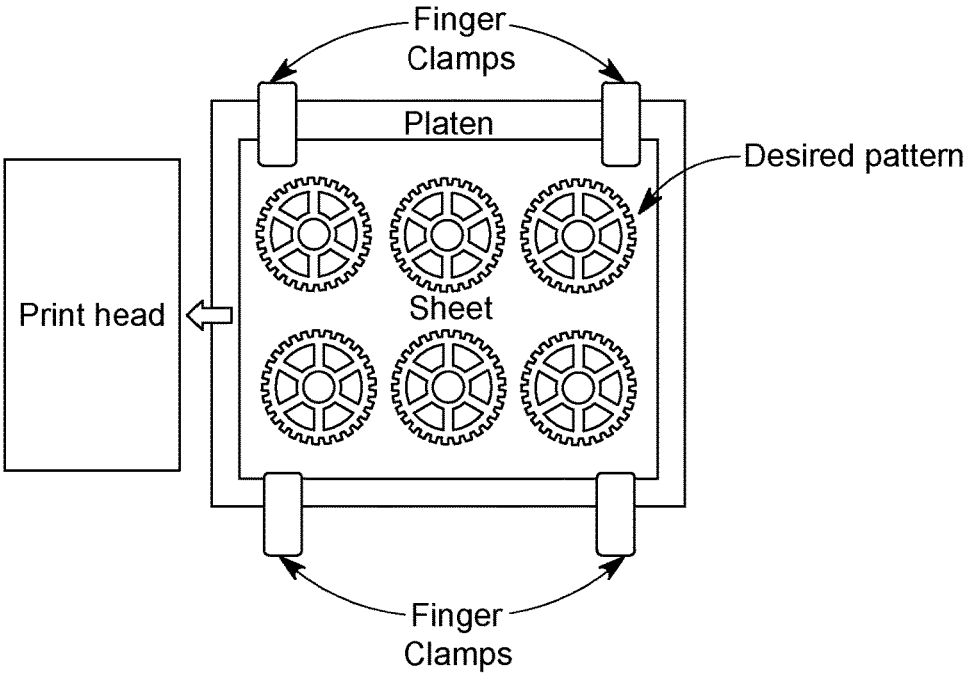
FIG. 3 shows a next step with all four clamps in the clamped configuration and a pattern printed on the substrate sheet.

1. Before a sheet is deposited onto the printing surface (platen), the clamping fingers are raised to the unclamped configuration (FIG. 1A) leaving the platen free to receive a sheet with the fingers of clamps out of the way of the sheet.
2. A sheet of the desired substrate (carbon fiber, fiberglass, etc.) is deposited onto the platen (FIG. 1B). This can be done using any of the variety of methods described in the CBAM patents and applications incorporated herein by reference.
3. During the placement of the sheet, the clamping fingers are turned inward and lowered to the clamped configuration (FIG. 1B), which secures the sheet to the platen by pinching it to the platen.
4. Once the sheet is secured to the platen by the clamping fingers, the clamping fingers can briefly disengage and rise in a pre-ordered fashion (FIGS. 2A-2B) so as to allow the sheet to relax and release any warp, or bow that may have been imparted to the sheet during the sheet placement onto the platen. At no time during this operation is the sheet not clamped by at least two clamping fingers. The flattening and relaxing step thus does not disrupt the overall sheet position on the platen.
5. Once the sheet has been allowed to relax to a flat state on the platen, all clamping fingers are engaged to the clamped configuration (FIG. 3).
6. A print head prints onto the clamped sheet (FIG. 3).

Figure 4:
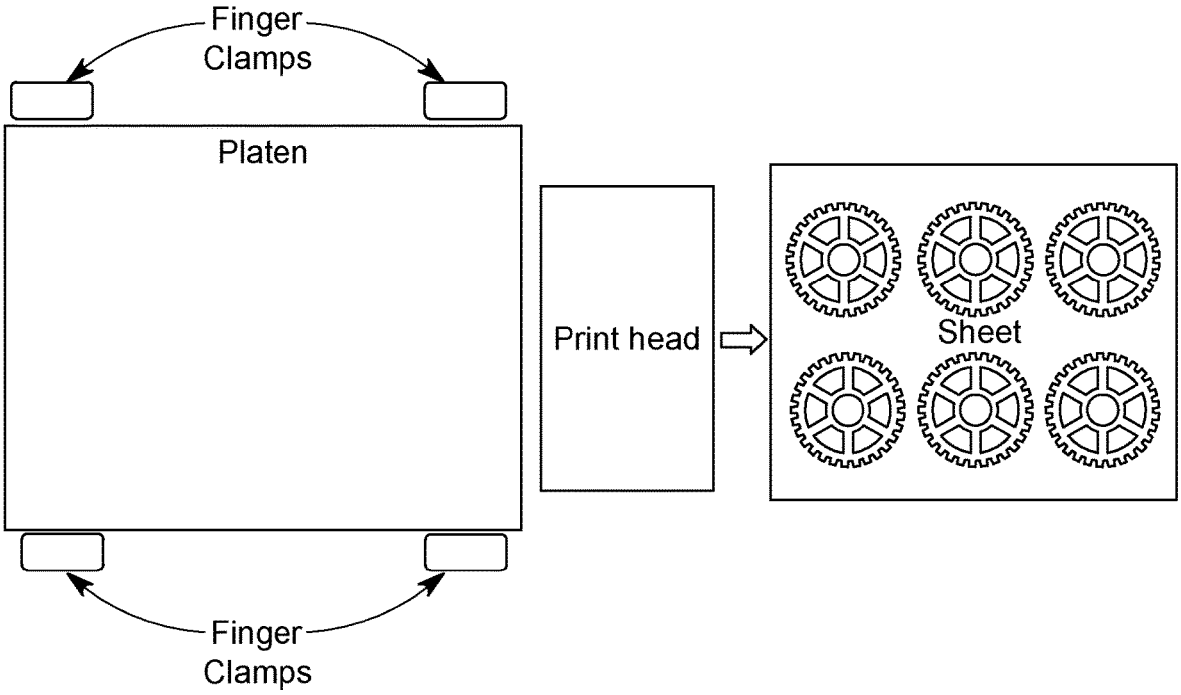
FIG. 4 shows a next step with all four clamps in the unclamped configuration and the sheet moved to the next station.

7. Once the print head has completed the print pattern, the clamping fingers are raised and turned once again to the unclamped configuration, and the sheet is removed from the platen (FIG. 4). This can be done using any of the variety of methods described in the CBAM patents and applications incorporated herein by reference.
8. The process repeats for as many sheets as need printing.

The sheets so-printed are then subject to the rest of the CBAM process that follows after printed sheets get collected and layered. This can be done using any of the variety of methods described in the CBAM patents and applications incorporated herein by reference. The end result is a composite-based 3D-printed part.

Finger Clamp Description

Figure 5A:
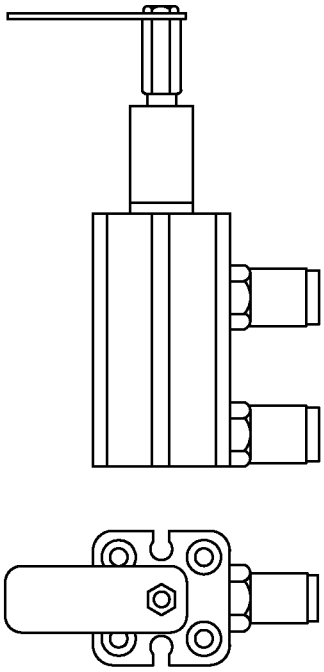
FIG. 5A shows a top and side views of a clamp in the clamped configuration.
Figure 5B:
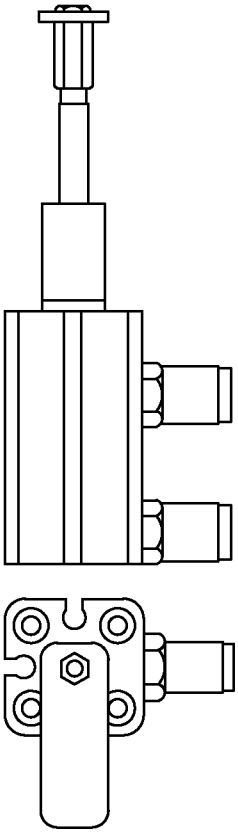
FIG. 5B shows a top and side views of a clamp in the unclamped configuration.
Figure 5C:
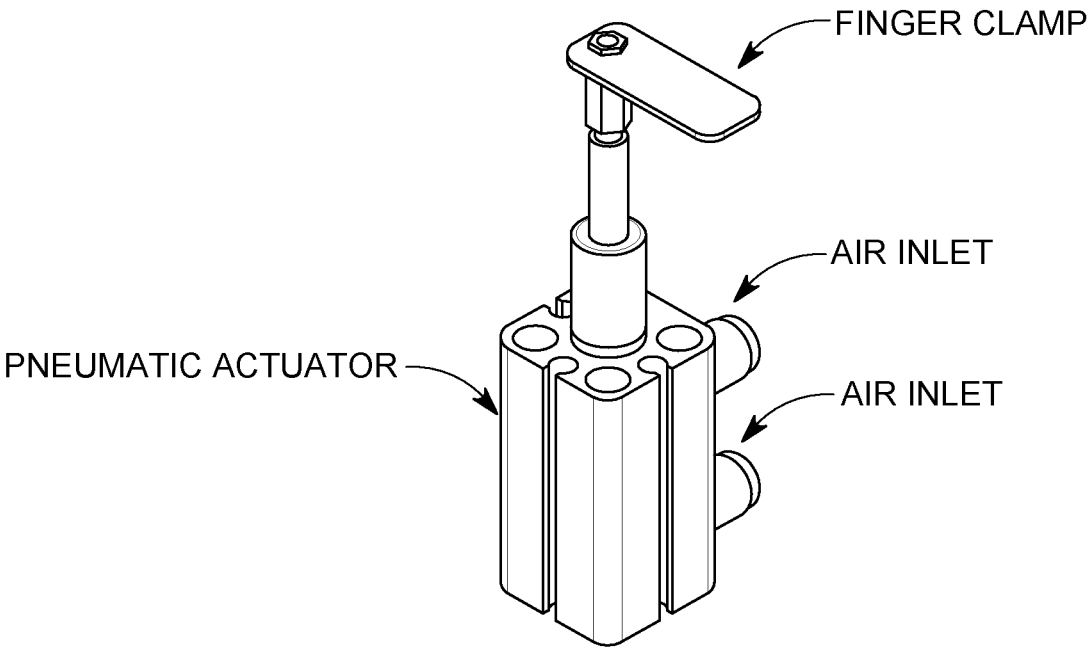
FIG. 5C shows a profile view of a clamp in the clamped configuration.

Turning to FIGS. 5A-5C, it can be seen that a finger clamp can include or be made from a variety of mechanisms and actuation forces to allow for gentle clamping of sheets. A particular embodiment includes a pneumatically driven barrel cam actuator with a gripping finger attached to the end effector of the pneumatic SMC MKB12-10RZ-A93L cylinder, rotary clamp manufactured by SMC Corporation Tokyo, Japan. Other products specified in the MK series of rotary clamp cylinders may also be appropriate for specific applications, according to the needs of and variations sought by the system designer, as would be appreciated by persons of ordinary skill in the art once informed of the teachings herein. The barrel cam allows for rotation during the vertical translation of the finger. This rotation is important as it allows for the gripping finger to be moved out of the way during operations in which the sheet needs to be moved from the platen, or allowed to relax.

Several descriptions and illustrations have been presented to aid in understanding the present invention. One with skill in the art will realize that numerous changes and variations may be made without departing from the spirit of the invention. Each of these changes and variations is within the scope of the present invention.

The invention claimed is:

1. A print system comprising:

a substantially flat print platen bed with a plurality of edge regions;

a plurality of finger clamps each comprising a gripping finger supported at the edge regions of the print platen bed;

a print head capable of movement across the flat print platen bed;

wherein, each finger clamp is constructed and constrained simultaneously both to move vertically with respect to the print platen bed and to rotate horizontally with respect to the print platen bed by means of respective barrel cam actuators that comprise one end effector attached to each gripping finger; the finger clamps having an unclamped configuration when rotated away from the print platen bed and raised above the print platen bed, and a clamped configuration when rotated over the print platen bed and lowered against the print platen bed;

further wherein each finger clamp exists in the clamped configuration during movement of the print head across the flat print platen bed.

2. The print platen of claim 1 wherein the print platen bed is substantially rectangular, and there are two edge regions with at least one finger clamp in each edge region.

3. The print platen of claim 2 wherein there are four finger clamps, two at each edge region.

* * * * *